US009266375B2

(12) United States Patent
Baecker

(10) Patent No.: US 9,266,375 B2
(45) Date of Patent: Feb. 23, 2016

(54) RUBBER ROLLERS WITH ROUGH SURFACE

(75) Inventor: Barbara Baecker, Leverkusen (DE)

(73) Assignee: FELIX BOETTCHER GMBH & CO. KG, Cologne (DE)

( * ) Notice: Subject to any disclaimer, the term of this patent is extended or adjusted under 35 U.S.C. 154(b) by 717 days.

(21) Appl. No.: 12/310,079

(22) PCT Filed: Aug. 9, 2007

(86) PCT No.: PCT/EP2007/058257

§ 371 (c)(1),
(2), (4) Date: Feb. 10, 2009

(87) PCT Pub. No.: WO2008/017700

PCT Pub. Date: Feb. 14, 2008

(65) Prior Publication Data

US 2009/0241789 A1 Oct. 1, 2009

(30) Foreign Application Priority Data

Aug. 10, 2006 (DE) ..... 10 2006 037 615

(51) Int. Cl.
*B41N 7/06* (2006.01)
*B41F 31/26* (2006.01)
*B41F 13/193* (2006.01)

(52) U.S. Cl.
CPC ..... *B41N 7/06* (2013.01); *B41F 13/193* (2013.01); *B41F 31/26* (2013.01); *B41N 2207/02* (2013.01); *B41N 2207/14* (2013.01)

(58) Field of Classification Search
CPC ..... B41F 31/26; B41F 31/001; B41F 13/193; B41N 7/06; B41N 7/08; B41N 2207/02
USPC ..... 101/352.13, 352.11; 492/37, 30, 28; 3/352.13, 352.11
See application file for complete search history.

(56) References Cited

U.S. PATENT DOCUMENTS 2,594,348 A * 4/1952 Rockoff ..... 492/37
3,467,009 A * 9/1969 Ross ..... 101/216

(Continued)

FOREIGN PATENT DOCUMENTS

DE 71 41 940 11/1971
DE 694 24 638 7/1995

(Continued)

OTHER PUBLICATIONS

EP 0 594 016 machine translation; The Internet, Mar. 4, 2015, 1st edition, 1st volume, all pages.*

*Primary Examiner* — Matthew G Marini
*Assistant Examiner* — Leo T Hinze
(74) *Attorney, Agent, or Firm* — Jacobson Holman PLLC

(57) ABSTRACT

A rubber-coated ink transfer roll having a hardness range of from 20 to 80 Shore A and a mean depth of roughness Rz of from 30 to 80 μm and a maximum depth of roughness $R_{max}$ of from 40 to 120 μm, a free specific volume $V_1$ from 0.001 to 0.1 $mm^3/mm^2$ and a free specific volume $V_2$ from 0.02 to 1.5 $mm^3/mm^2$.

12 Claims, 2 Drawing Sheets

(56) References Cited

U.S. PATENT DOCUMENTS

| | | | | | |
|---|---|---|---|---|---|
| 3,924,313 | A | * | 12/1975 | Broderick | 492/37 |
| 4,195,570 | A | * | 4/1980 | Haren | 101/348 |
| 5,033,380 | A | * | 7/1991 | Sonobe et al. | 101/350.1 |
| 5,184,552 | A | * | 2/1993 | Ijichi | 101/348 |
| 5,445,588 | A | | 8/1995 | Ishibashi et al. | |
| 5,647,279 | A | * | 7/1997 | Johner et al. | 101/401.1 |
| 8,006,617 | B2 | * | 8/2011 | Schneider et al. | 101/351.1 |
| 8,561,536 | B2 | * | 10/2013 | MacFarlane | B41F 31/26 101/352.11 |
| 2009/0090261 | A1 | * | 4/2009 | Schneider et al. | 101/352.11 |

FOREIGN PATENT DOCUMENTS

| | | | |
|---|---|---|---|
| EP | 0 662 394 | A | 7/1995 |
| EP | 594016 | B1 * | 1/1996 |
| GB | 729561 | | 5/1955 |
| GB | 1 406 636 | | 9/1975 |
| GB | 2 044 398 | A | 10/1980 |
| JP | 62119238 | | 5/1987 |
| JP | 623965 | | 2/1994 |
| JP | 2003237249 | | 8/2003 |

* cited by examiner

RUBBER ROLLERS WITH ROUGH SURFACE

This is a 371 of PCT/EP2007/058257 filed Aug. 9, 2007.

The present invention pertains to rubber-coated ink transfer rolls, processes for the manufacture thereof and the use thereof.

Inking units in offset printing presses are often equipped with continuous-type inking systems. Here, the ink supply continuously proceeds from the ink fountain via the ink fountain roll to the adjacent film roll. A nip of about 0.04 to 0.10 mm exists between the ink fountain roll and the film roll. A rubber-coated ink transfer roll having a hardness range of 20-80 Shore A is arranged downstream of the film roll to transport the ink into the roll system of the inking unit. In offset printing, rubber-coated rollers usually have a smooth surface with mean depths of roughness Rz of <20 μm, typically <10 μm.

EP 0 662 394 A1 pertains to a print roll with grooves forming a rhombus pattern. The roll described there is mounted in an inking unit downstream of an ink fountain roller and corresponds to a film roll.

DE 71 94 940 pertains to a dip roll for inking units. The dip roll has crosswise recesses resulting in rhombic areas.

Typically, the ink layer thickness in the ink supply area is higher than in the downstream components of the inking unit. Then, an ink splashing occurs between the ink fountain roll and the film roll in particular at the exiting side of the nips.

The problem addressed by the invention was to avoid the above-mentioned problems, in particular to reduce the problem of ink splashing or ink fogging.

Surprisingly, it has been found that said problem may be reduced using a rubber-coated ink transfer roll having a rough surface. Said roll has the feature of transferring the ink film more effectively from the film roll into the inking unit. Due to this fact the provided ink, i.e., the ink layer thickness on the film roll may be reduced which positively affects the problem of fogging and ink splashing.

According to the invention, the surface of the rubber-coated ink transfer roll has a mean depth of roughness Rz of from 30 to 80 μm and a maximum depth of roughness $R_{max}$ of from 40 to 120 μm.

Preferably, the rubber-coated ink transfer roll has a free specific volume $V_1$ from 0.001 to 0.1 $mm^3/mm^2$.

Preferably, the rubber-coated ink transfer roll has a free specific volume $V_2$ from 0.02 to 1.5 $mm^3/mm^2$.

The depths of roughness are measured with a roughness meter using the profile method (perthometer) according to DIN EN ISO 4287.

Preferably, the mean depth of roughness ranges from 40 to 60 μm and/or the maximum depth of roughness is from 60 to 100 μm.

A suitable process for manufacturing such ink transfer rolls is based on the machining of a rubber-coated roll with a porcupine cutter. This treatment removes the top rubber layer and leaves an irregular structure partially having a scalelike appearance (8) (see FIG. 1).

The structures according to the invention are rough and non-uniform. The structure is scaly and random, as in FIG. 1, which does not contain higher-order structures such as grooves or rhombuses.

Suitable rubber substances for the ink transfer roll are acrylonitrile-butadiene rubber (NBR), hydrogenated acrylonitrile-butadiene rubber (HNBR), chloroprene rubber (CR), epichlorohydrin rubber (ECO), styrene-butadiene rubber (SBR) and copolymers and blends thereof.

The ink transfer roll has a core made from a dimensionally stable material, e.g., steel, aluminium or carbon fiber reinforced plastics (CFRP) or glass fiber reinforced plastics (GFRP).

The free volumes $V_1$ and $V_2$ may be measured, e.g., using a RFT MicroProf® with a chromatic sensor (CWL) with irradiating the samples with focused white light. The sensor measures the wavelength-dependent (chromatic) distribution of the reflected light and determines the absolute height information therefrom.

This measuring principle avoids measuring errors due to edge effects otherwise common to optical methods. The surface topography is obtained in the form of a quantitative data field. Hence, any distances, heights and angles, roughnesses and corrugations and also flatnesses may be measured in pictures subsequent to the measurement.

The volumes $V_1$ and $V_2$, which may be calculated from topographical photographs, are especially suited for characterizing surfaces. Then, the filling volume $V_1$ is the filling volume between the deepest measuring point and the height of the mean plane, the latter being assigned the height value of 0. The filling volume $V_2$ is determined between the deepest and the highest measuring points of a topographical photograph.

FIG. 2 schematically shows the differences between the filling volumes $V_1$ and $V_2$. The grey area illustrates the calculated volumes.

Another subject matter is the use of a rubber-coated roll having a mean depth of roughness $R_z$ from 30 to 80 μm and a maximum depth of roughness $R_{max}$ from 40 to 120 μm as an ink transfer roll in particular in offset printing.

Another embodiment of the invention is an inking unit containing the in transfer roll of the invention.

Figure 1:
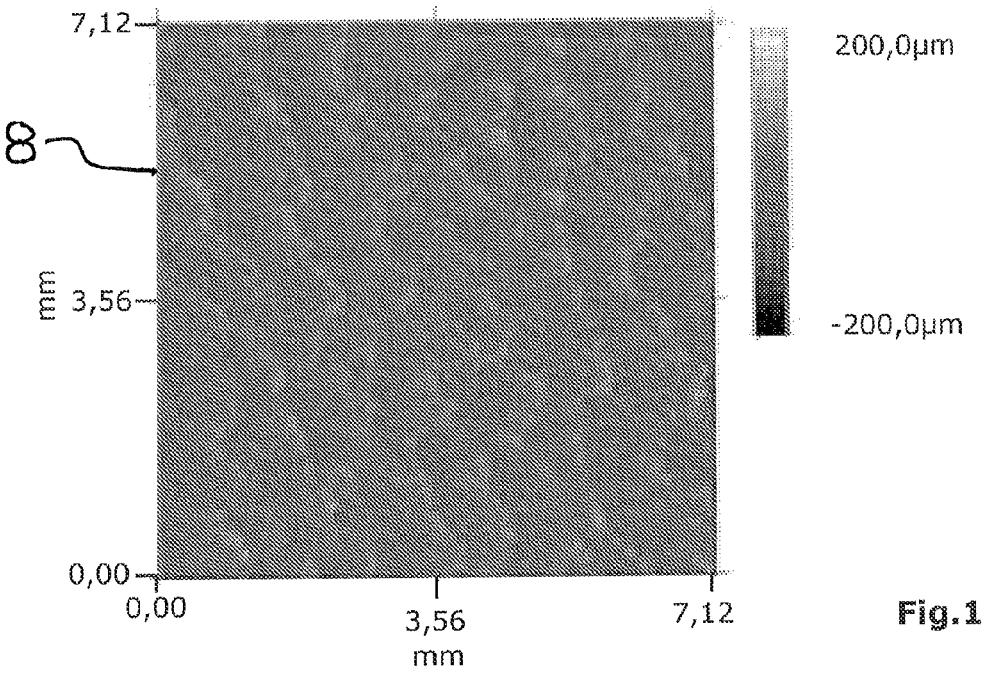
FIG. 1 shows a topographical photograph of the surface obtained with a chromatic sensor (CWL).
Figure 2:
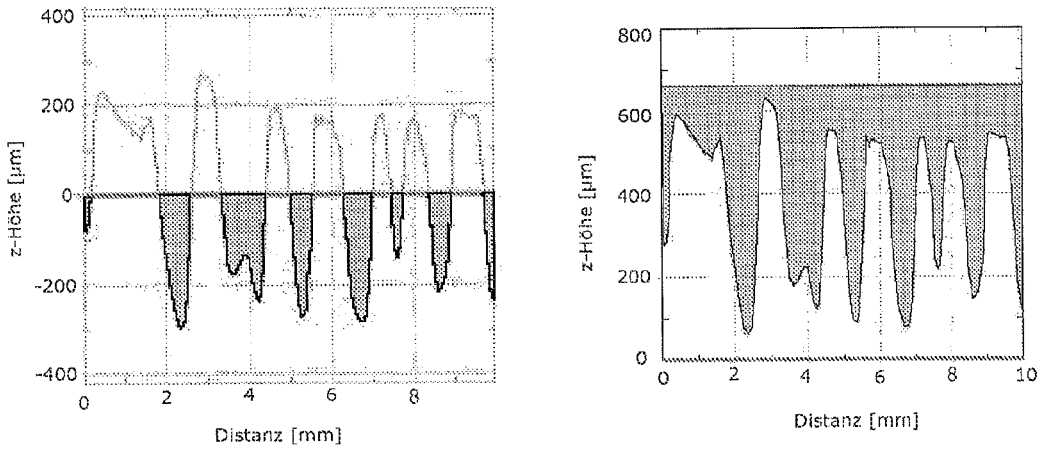
FIG. 2 shows the difference between the free volumes $V_1$ (LH side) and $V_2$ (RH side).
Figure 3:
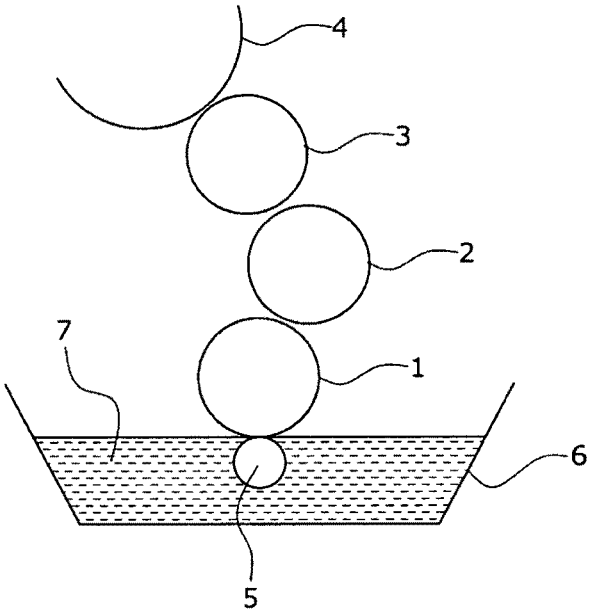

FIG. 3 schematically shows components of an inking unit. Said inking unit contains an ink fountain roll 1, a film roll 2 and an ink transfer roll 3. The figure additionally shows a dip roll 5 and an ink fountain 6 containing an ink 7.

The invention will be illustrated in more detail by the following example.

EXAMPLE

An ink transfer roll of 105 mm in diameter and 1035 mm in length having a steel core and an NBR coating was machined with a porcupine cutter (single grit rubber hog wheel). The following machining conditions were observed.

| No. of cutting steps | Co-rotation/ counter-rotation | Circumferential speed of the tool in m/s | Infeed in mm | Workpiece speed in rpm | Rate of feeding in mm/mm |
|---|---|---|---|---|---|
| 1st cutting step | Counter-rotation | 50 | Approx-imately 10 | 380 | 400 |
| 2nd cutting step | Counter-rotation | 50 | 0.5 | 380 | 350 |

The depth of roughness of the so-obtained roll was measured. The $R_{max}$ value was 80 μm, the mean depth of roughness $R_z$ was approximately 52 μm. $V_1$ was 0.012 $mm^3/mm^2$, $V_2$ was 0.191 $mm^3/mm^2$. It is important to avoid feed marks by ensuring a uniform machining.

The invention claimed is:

1. A rubber-coated ink transfer roll having a hardness range of from 20 to 80 Shore A and a rough, irregular, non-uniform, stochastic surface having a mean depth of roughness Rz of from 30 to 80 μm, a maximum depth of roughness $R_{max}$ of from 40 to 120 μm, a free specific volume $V_1$ from 0.001 to 0.1 $mm^3/mm^2$, and a free specific volume $V_2$ from 0.02 to 1.5 $mm^3/mm^2$.

2. The ink transfer roll according to claim 1 obtainable by a process wherein the surface structure of a rubber-coated ink transfer roll is machined with a porcupine cutter.

3. The ink transfer roll according to claim 1 characterized in that the rubber coating is selected from acrylonitrile-butadiene rubber (NBR), hydrogenated acrylonitrile-butadiene rubber (HNBR), chloroprene rubber (CR), epichlorohydrin rubber (ECO), styrene-butadiene rubber (SBR) and copolymers and blends thereof.

4. The ink transfer roll according to claim 1 characterized in that the core of the roll is made from steel, aluminium or carbon fiber reinforced plastics (CFRP) or glass fiber reinforced plastics (GFRP).

5. The ink transfer roll according to claim 1, characterized in that the free volume $V_1$ is from 0.003 to 0.05 $mm^3/mm^2$.

6. The ink transfer roll according to claim 1, characterized in that the free volume $V_2$ is from 0.06 to 1.0 $mm^3/mm^2$.

7. An inking unit having at least one ink fountain roll (1), a film roll (2) downstream thereof and an ink transfer roll (3) downstream thereof characterized in that said ink transfer roll (3) is an ink transfer roll according to claim 1.

8. The use of an ink transfer roll according to claim 1 comprising transferring an ink film from the ink transfer roll into an inking unit.

9. The use according to claim 8 in an offset printing process.

10. The use according to claim 8 to reduce ink splashing and/or ink fogging.

11. A process for manufacturing an ink transfer roll according to claim 1 comprising the following steps:

machining a rubber-coated roll using a porcupine cutter.

12. A rubber-coated ink transfer roll having a hardness range of from 20 to 80 Shore A and a rough surface having a mean depth of roughness Rz of from 30 to 80 μm, a maximum depth of roughness $R_{max}$ of from 40 to 120 μm, a free specific volume $V_1$ from 0.001 to 0.1 $mm^3/mm^2$, and a free specific volume $V_2$ from 0.02 to 1.5 $mm^3/mm^2$, the surface having no crosswise grooves forming a rhombus pattern.

* * * * *